US012674284B2

(12) United States Patent
Sandberg et al.

(10) Patent No.: US 12,674,284 B2
(45) Date of Patent: Jul. 7, 2026

(54) METHOD FOR COATING A HOLLOW CONTAINER COMPRISING MOLDED PULP

(71) Applicant: Billerud Aktiebolag (publ), Solna (SE)

(72) Inventors: Lars Sandberg, Hammarö (SE); Yselaure Boissard, Örebro (SE); Shoko Yamada, Vintrie (SE); Andreas Nyström, Karlstad (SE); Christopher T. Karlsson, Hammarö (SE)

(73) Assignee: ALPLA WERKE ALWIN LEHNER GMBH & CO KG, Hard (AT)

( * ) Notice: Subject to any disclaimer, the term of this patent is extended or adjusted under 35 U.S.C. 154(b) by 278 days.

(21) Appl. No.: 18/551,924

(22) PCT Filed: Mar. 25, 2022

(86) PCT No.: PCT/EP2022/057989
§ 371 (c)(1),
(2) Date: Sep. 22, 2023

(87) PCT Pub. No.: WO2022/207507
PCT Pub. Date: Oct. 6, 2022

(65) Prior Publication Data

US 2024/0167228 A1 May 23, 2024

(30) Foreign Application Priority Data

Mar. 31, 2021 (EP) ..... 21166391

(51) Int. Cl.
*D21J 1/08* (2006.01)
*B65D 1/02* (2006.01)
(Continued)

(52) U.S. Cl.
CPC ..... *D21J 1/08* (2013.01); *B65D 1/0215* (2013.01); *B65D 23/02* (2013.01);
(Continued)

(58) Field of Classification Search
CPC .. D21J 1/08; D21J 3/10; B65D 1/0215; B65D 23/02; B65D 23/0821; B65D 65/42;
(Continued)

(56) References Cited

U.S. PATENT DOCUMENTS 4,283,189 A 8/1981 Itoh
5,997,643 A 12/1999 Wilson et al.
(Continued)

FOREIGN PATENT DOCUMENTS

EP 3708709 A1 * 9/2020 ..... D21J 3/10
JP 2000109077 A 4/2000
(Continued)

OTHER PUBLICATIONS

Envirotech Website, Electrostatic Coating Definition, http://www.etfinancial.com/coatingsequip.htm, Jan. 2009 http://www.etfinancial.com/coatingsequip.htm—Envirotech Financial Website (Year: 2009).*
(Continued)

*Primary Examiner* — Don M Anderson
*Assistant Examiner* — John Martin Hoppmann
(74) *Attorney, Agent, or Firm* — Stites & Harbison PLLC; Richard S. Myers, Jr.

(57) ABSTRACT

The present disclosure generally relates to a method for providing a barrier coating on a hollow container (100) comprising molded pulp. The method comprises providing a polymeric powder coating onto the interior surface (105*a*) and at least a portion of the exterior surface of the container (100) prior to curing and/or melting the powder coatings. The present disclosure also relates to a hollow container (100) formed by the method.

14 Claims, 3 Drawing Sheets

(51) Int. Cl.

| | |
|---|---|
| ***B65D 23/02*** | (2006.01) |
| ***B65D 23/08*** | (2006.01) |
| ***B65D 65/42*** | (2006.01) |
| ***D21H 19/22*** | (2006.01) |
| ***D21H 19/84*** | (2006.01) |
| ***D21H 21/16*** | (2006.01) |
| ***D21H 23/50*** | (2006.01) |
| ***D21H 23/72*** | (2006.01) |
| ***D21J 3/10*** | (2006.01) |

(52) U.S. Cl.
CPC ..... *B65D 23/0821* (2013.01); *B65D 65/42* (2013.01); *D21H 19/22* (2013.01); *D21H 19/84* (2013.01); *D21H 21/16* (2013.01); *D21H 23/50* (2013.01); *D21H 23/72* (2013.01); *D21J 3/10* (2013.01); *B65D 2565/387* (2013.01)

(58) Field of Classification Search
CPC ..... B65D 2565/387; B65D 1/0207; D21H 19/22; D21H 19/84; D21H 21/16; D21H 23/50; D21H 23/72; D21H 19/06; D21H 27/10; B29D 22/003
USPC ..... 162/218, 382; 239/706; 215/12.1; 264/86; 118/317, 621, DIG. 3; 427/236, 427/233
See application file for complete search history.

(56) References Cited

U.S. PATENT DOCUMENTS

| | | | | |
|---|---|---|---|---|
| 7,048,975 | B1 * | 5/2006 | Tojo | B65D 1/0215 428/34.3 |
| 2012/0082788 | A1 * | 4/2012 | Bauvin | B05B 13/0681 427/233 |

FOREIGN PATENT DOCUMENTS

| | | | | |
|---|---|---|---|---|
| WO | WO-0168984 | A1 * | 9/2001 | D21J 1/06 |
| WO | 2010/022267 | A1 | 2/2010 | |
| WO | WO-2013192260 | A1 * | 12/2013 | B29C 49/24 |
| WO | WO-2019034707 | A1 * | 2/2019 | B29C 49/071 |
| WO | 2019/175610 | A1 | 9/2019 | |

OTHER PUBLICATIONS

European Patent Office, International Search Report and Written Opinion issued in corresponding Application No. PCT/EP2022/057989, mailed Jun. 17, 2022.

* cited by examiner

METHOD FOR COATING A HOLLOW CONTAINER COMPRISING MOLDED PULP

CROSS REFERENCE TO RELATED APPLICATIONS

This application is a § 371 National Phase Application of PCT/EP2022/057989 filed Mar. 25, 2022, which claims priority to EPO 21166391.9 filed Mar. 31, 2021.

TECHNICAL FIELD

The present disclosure generally relates to a method for providing a barrier coating on a hollow container comprising molded pulp. The method comprises providing a polymeric powder coating onto the interior surface and at least a portion of the exterior surface of the container prior to curing and/or melting the powder coatings. The present disclosure also relates to a hollow container formed by the method.

BACKGROUND

Plastic containers, packaging trays and bottles are extensively used for storing food products, such as flowable food and beverages. Plastic articles can be easily molded, stretched, and produced at a relatively low cost. However, the use of plastics is associated with environmental concerns. In order to relieve the environmental burden, attempts have been made to replace plastic containers and bottles with renewable materials, such as molded pulp.

Shaped pulp products, such as paper containers and bottles may be formed by feeding pulp, e.g. paper pulp into a split mold and subsequently dewatering the pulp with heat and/or pressure, as disclosed in e.g. WO16055072.

Although paper is regarded as a sustainable packaging material, paper has a number of drawbacks compared to traditional plastics. Paper is generally more permeable to gases, grease, and moisture. Long-time exposure to moisture, as is typically the case during storage of beverages, may lead to deterioration of the inner walls of the paper container.

To that end, the inner walls of the paper container may be coated with a barrier coating to protect the container from deteriorating due to liquid and moist exposure. Barrier coatings may also be used to control the humidity, sealing properties, aroma etc. of the container.

Barrier coatings typically comprise polymers, such as polyolefin polymers, and may be applied to the inner container walls in various ways, e.g. by extrusion coating or applied as liquid coatings.

In order to reduce the emission of volatile organic compounds (VOC) and coating waste, powder coatings have gained attention in recent years.

A powder coating is a dry, finely divided solid material that is commonly used on electrically conductive metal substrates. The deposition of a powder coating is typically achieved by electrostatic forces. For example, the powder may be charged by corona discharge and then sprayed onto a grounded substrate. Accordingly, a powder layer is applied to the substrate, which is subsequently heated such that the powder melts and forms a continuous film on the substrate.

The deposition of a powder coating onto a molded pulp substrate is, however, challenging due to the inherent non-conductive properties of such a substrate. The coating is not assisted by electrostatic attraction, which may result in poor adhesion of the powder to the substrate, and in an uneven powder deposition.

The complexity of depositing a powder coating increases if the product to be coated is shaped as a hollow container, e.g. a bottle. In such cases, it may also be desirable to coat the upper exterior part of the container, i.e. the portion surrounding the opening of the container. This portion of the product is typically subject to repeated exposure to moist and liquid during drinking or pouring from the container.

Accordingly, there is a need to provide a simplified method for applying a powder coating to a molded pulp container used for storage of flowable food or beverages, wherein the surfaces of the container being predominantly exposed to moist and liquid are provided with a protective and durable barrier coating.

SUMMARY

In view of the above, there is a need for an improved and simplified method for the provision of a powder coating on a hollow container comprising molded pulp, which method results in a liquid and moist barrier coating that protects the most exposed parts of the container.

According to a first aspect, there is provided a method for providing a barrier coating on a hollow container comprising molded pulp, the method comprising:

a) providing a hollow container comprising molded pulp, wherein the hollow container comprises a main portion and an upper portion; the hollow container extending along a longitudinal center line, wherein the longitudinal extension of the upper portion corresponds to 5-30% of the maximum longitudinal extension of the hollow container, and wherein the longitudinal extension of the main portion corresponds to 70-95% of the maximum longitudinal extension of the hollow container, wherein the hollow container comprises a bottom surface and sidewalls extending from the bottom surface to an opening of the hollow container; the sidewalls and the bottom surface defining an exterior surface and an interior surface of the hollow container, b) depositing a polymeric powder onto the interior surface of the hollow container by means of a spraying device capable of charging the polymeric powder prior to or during deposition of the powder, wherein at least the main portion of the hollow container is grounded during the polymeric powder deposition, c) depositing a polymeric powder onto the exterior surface of at least a portion of the upper portion of the hollow container by means of the spraying device, d) treating the hollow container with heat or irradiation under conditions that melt and/or cure the polymeric powder after the steps b) and c).

The present disclosure is based on the realization that both the interior surface and a portion of the exterior surface of the hollow container can be coated prior to treatment with heat or irradiation; i.e. prior to formation of a continuous barrier coating. Accordingly, the most "vulnerable" parts of the container; i.e. the parts predominantly exposed to moist and liquid during use, can be coated in one step, and only one heating or irradiation step is required in the method.

Depositing a powder coating onto these portions of a hollow container is associated with complex processability. First, because the molded pulp substrate as such is non-conductive. Second, because the coating of both the interior container surface and the exterior surface of the upper portion can typically not be performed in one step. In most applications, it is generally required to first provide an interior powder coating, thereafter melt and/or cure the powder coating, and in a separate step, provide an exterior coating, and subsequently melt and/or cure the exterior coating in a second step.

A hollow container formed according to the method of the present disclosure only requires one step of heat or irradiation treatment after the interior surface and the exterior surface of a portion of the upper portion have been coated. Accordingly, significant savings in time and costs, and a more simplified method is provided.

The polymeric powder particles are electrically charged by means of the spraying device, and due to its negative (or positive) electric charge, the powder will seek a grounded surface which has a more positive (or negative) charge. Accordingly, the powder particles will adhere to the container surface. During the subsequent heating or irradiation step, the applied polymeric powder coating will melt and cure such that an even and durable protective barrier coating is provided.

In exemplary embodiments, the hollow container has a moisture content of from 3 to 15%, e.g. from 5 to 10% during the steps of polymeric powder depositions.

A moisture content in the above ranges allows for an even polymeric powder coating to be applied. If the moisture content is too high, the surface of the hollow container may repel the polymeric powder, and thereby yield an uneven coating. If the moisture content is too low, the polymeric powder may not adhere properly to the surface of the hollow container.

In exemplary embodiments, the polymeric powder deposition step b) of the method is carried out in a molding device comprising an electrically conductive material; the molding device being configured to enclose at least a portion of the main portion of the hollow container.

Typically, the molding device is configured to enclose the entire main portion of the hollow container.

Accordingly, a large portion of the hollow container is electrically charged during the polymeric powder deposition step(s), and an even powder coating will be applied across the interior surface of the hollow container.

The molding device may comprise any electrically conductive material.

If the electrically conductive material is e.g. a metal, a higher moisture content may be required during the polymeric powder deposition step, such as in the range of from 8 to 15%.

In exemplary embodiments, the molding device comprises a formable electrically conductive material.

The inventors have found that the utilization of a formable electrically conductive material has an enhanced ability to adapt or conform to the shape of the hollow container. This way, the polymeric powder deposition step(s) may be performed at a lower moisture content range, e.g. in the range of from 3 to 10%, e.g. 5 to 10%. Furthermore, an even coating thickness is achieved.

In exemplary embodiments, the method further comprises the step of:

a') conditioning the hollow container at an ambient relative humidity of from 30 to 100% after step a) of providing the hollow container comprising molded pulp.

In embodiments where a formable electrically conductive material is utilized, the conditioning is typically performed at an ambient relative humidity of from 30 to 100%, e.g. from 30 to 75%.

In embodiments where the polymeric powder deposition step b) of the method is carried out in a molding device comprising metal as the electrically conductive material, the conditioning of the hollow container is preferably carried out at an ambient relative humidity of from 60 to 100%, e.g. from 75 to 95%.

Conditioning the hollow container at an ambient relative humidity in the above mentioned ranges prior to the steps of polymeric powder deposition; i.e. steps b) and c) of the method, allows for a homogenous and even coating to be provided prior to the step of curing or melting the powder coating.

The moisture content of the hollow container has an impact on the ability of the hollow container to be coated on both the interior surface and the exterior surface of at least the upper portion.

A moisture content in the above ranges allows for at least a portion of the upper portion to be coated without connection to a grounded electrically conductive surface; i.e. only a portion of the hollow container needs to be connected to a grounded electrically conductive surface during powder deposition. Typically, since pulp is inherently non-conductive, the presence of a grounded electrically conductive surface is required for the powder to adhere to the pulp container. However, with a moisture content in the above mentioned range, this is not required.

The moisture content of the hollow container may be selectively steered and controlled depending on the size of the container and depending on the use of the container. For example, in some situations, it may be desired to coat a large proportion of the upper portion of the container, whereas in others, only a smaller proportion may be desired. By tailoring the moisture content and/or the relative humidity level during conditioning, situation-specific adjustments may be accomplished.

Furthermore, the moisture content in the above mentioned ranges allows for the deposition of polymeric powder on both the interior and exterior surface of the container walls to be accomplished simultaneously or in consecutive order. Accordingly, no melting and/or curing step is required between steps b) and c) of the method.

In exemplary embodiments, the polymeric powder deposition steps b) and c) are performed simultaneously.

This may be accomplished by arranging the spraying device; i.e. the tip of the spraying device, in proximity of the opening of the hollow container and along the longitudinal center line of the container. This way a flow of charged polymer powder particles is directed towards the interior surface of the container walls, while also at least partly covering the exterior surface of the upper portion of the container.

The polymeric powder deposition step c) may be performed by arranging the spraying device at a distance, d1, of from 10 mm to 250 mm, preferably of from 40 mm to 150 mm from the opening of the hollow container.

The tip of the spraying device is typically arranged along the longitudinal center line such that the flow of polymeric powder particles can cover the entire surface of the upper portion, if desired.

Accordingly, the spraying device may in the first polymeric powder deposition step b), either be inserted into the opening, or arranged in proximity of the opening during spraying. The charged polymeric powder particles will be electrically attracted to, and allowed to adhere to the interior surface of the hollow container.

Subsequently, the spraying device may be removed from the container opening and arranged at the distance, d1, from the opening of the container. The nozzle or tip of the spraying device is typically arranged vertically from the opening of the container; i.e. along the longitudinal center line of the container. This is to secure coverage of the powder on a large surface of the upper portion of the hollow container.

As mentioned hereinbefore, the polymeric powder deposition step b) may be carried out in a molding device comprising an electrically conductive material.

In such embodiments, the molding device may comprise at least a first and a second removable portion, wherein the first removable portion is configured to enclose the upper portion of the hollow container and wherein the second removable portion is configured to enclose the main portion of the hollow container.

The spraying device imparts a charged field such that the polymeric powder particles are charged and electrically attracted to the grounded and electrically conductive surfaces of the hollow container. During the polymeric powder deposition step b), the first and the second removable portions of the molding device may be arranged to enclose both the main and the upper portion of the hollow container. Accordingly, the entire interior surface of the container is electrically charged during polymeric powder deposition of the interior part of the container. A flow of electrically charged polymeric powder particles is directed to the interior surface of the hollow container and will adhere thereto. By securing efficient grounding and enclosing both the main portion and the upper portion of the container during the polymeric powder deposition step b), the electrical charge carried by the grounded surface will be spread across the entire area of the interior surface. Accordingly, an even powder coating will be applied across the interior surface of the hollow container.

In embodiments where the hollow container has a moisture content in the range of from 3 to 15%, e.g. 5 to 15%, the polymeric powder deposition step b) may be carried out with only the second removable portion present.

Accordingly, in step b), a spraying device, such as a spray gun, may be inserted into the opening of the hollow container (or in proximity of the opening) in order to coat the interior surface of the container.

In exemplary embodiments, the first removable portion is removed from the molding device during the polymeric powder deposition step c).

Subsequent to the polymeric powder deposition step b), the first removable portion (configured to enclose the upper portion of the container) may be removed, and the spraying device may be removed from the interior or the opening of the container and arranged at a distance from the container. Spraying of at least a portion of the upper portion of the container can then be accomplished. During this step (step c), the upper portion of the container is not connected to a grounded electrically conductive surface.

Accordingly, a simplified method for providing both an interior barrier coating and an exterior barrier coating is provided. The method only requires one or two spray sequences and only one heat or irradiation treatment following the spray sequence(s).

Furthermore, this is beneficial since only the exterior surface of the upper portion will be coated. Preferably, the exterior surface of the main portion of the container does not comprise any barrier coating; i.e. it is void of a barrier coating comprising polymeric powder. This is to yield a more paper like and "raw feel" on the main part of the container.

In preferred embodiments, the hollow container is a bottle, wherein the upper portion comprises a shoulder portion and a neck portion, wherein the neck portion has a smaller cross-sectional area than the main portion and is configured to circumferent at least the opening of the bottle and wherein the shoulder portion is arranged to taper between the main portion and the neck portion.

In embodiments, at least the neck portion of the upper portion of the bottle is coated in the polymeric powder deposition step c).

In the case of a bottle, the neck portion is preferably coated since this portion is exposed to moist and liquid when a person drinks from the bottle or when flowable food or liquid is poured from the bottle.

In embodiments, the entire upper portion of the hollow container is coated in the polymeric powder deposition step c).

In some situations, it may be desirable to cover the entire upper portion of the bottle. In such embodiments, a higher moisture content of the hollow container may be required during the polymeric powder deposition (steps b and c).

In the last step d) of the method of the present disclosure, the hollow container is treated with heat or irradiation under conditions that melt and/or cure the polymeric powder after the steps b) and c).

In embodiments, the curing step d) is performed by heating the hollow container at a temperature of from 120° C. to 220° C., for 1 to 30 minutes.

Accordingly, a uniform barrier coating is provided on the interior surface and exterior surface of the upper portion of the container.

The thickness of the barrier coating formed by the method of the present disclosure may be in the range of from 5 to 300 μm, e.g. from 20 to 100 μm.

According to another aspect of the present disclosure, there is provided a hollow container formed by the method described hereinbefore.

The hollow container comprises a main portion and an upper portion; the hollow container extending along a longitudinal center line, wherein the longitudinal extension of the upper portion corresponds to 5-30% of the maximum longitudinal extension of the hollow container, and wherein the longitudinal extension of the main portion corresponds to 70-95% of the maximum longitudinal extension of the hollow container, wherein the hollow container comprises a bottom surface and sidewalls extending from the bottom surface to an opening of the hollow container; the sidewalls and the bottom surface defining an exterior surface and an interior surface of the hollow container, wherein the hollow container comprises a barrier coating comprising polymeric powder on the interior surface of the hollow container and on the exterior surface of at least a portion of the upper portion of the hollow container.

In embodiments, the hollow container is a bottle. In such embodiments, the upper portion typically comprises a shoulder portion and a neck portion, wherein the neck portion has a smaller cross-sectional area than the main portion and is configured to circumferent at least the opening of the bottle, and wherein the shoulder portion is arranged to taper between the main portion and the neck portion, wherein the bottle comprises a barrier coating comprising polymeric powder on the interior surface of the bottle and on at least the exterior surface of the neck portion of the bottle.

The thickness of the barrier coating may be in the range of from 5 to 300 μm, preferably from 20 to 100 μm.

Accordingly, the moisture barrier properties of the hollow container are improved.

In embodiments, the exterior surface of the main portion of the bottle is void of a barrier coating comprising polymeric powder.

This is to achieve a "raw" paper like appearance on the exterior surface of the main portion of the bottle. Accordingly, only the portions of the bottle that are exposed to moist and liquid are provided with a barrier coating.

Further features of, and advantages with, the present disclosure will become apparent when studying the appended claims and the following description. The skilled addressee realizes that different features of the present disclosure may be combined to create embodiments other than those described in the following, without departing from the scope of the present disclosure.

BRIEF DESCRIPTION OF DRAWINGS

The various aspects of the present disclosure, including its particular features and advantages, will be readily understood from the following detailed description and the accompanying drawings, in which.

DETAILED DESCRIPTION

Figure 1A:
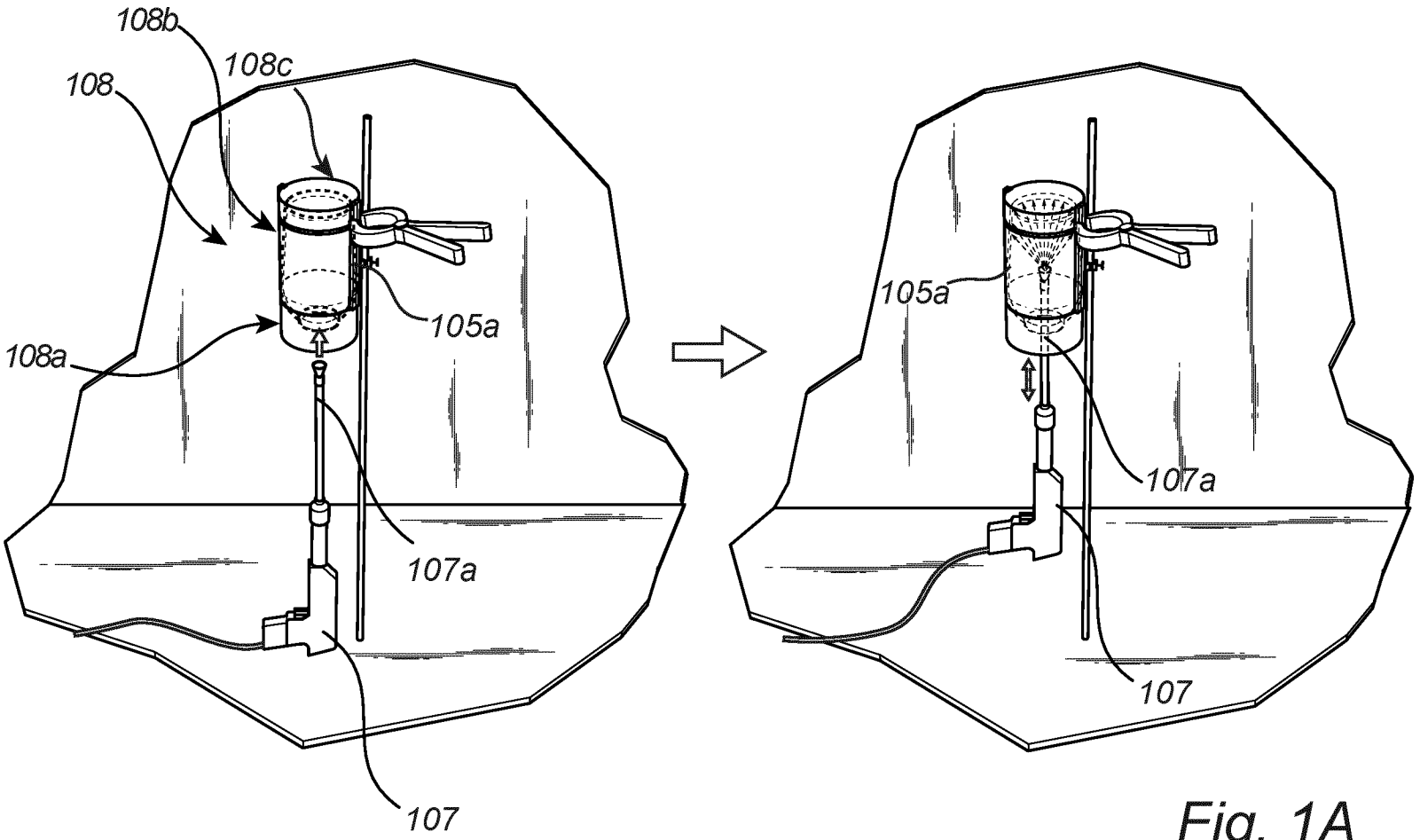
FIG. 1*a* schematically illustrates the step of providing an interior barrier coating according to an exemplary embodiment of the method of the present disclosure.

The present disclosure will now be described more fully hereinafter with reference to the accompanying drawings, in which currently preferred embodiments of the present disclosure are shown. The present disclosure may, however, be embodied in many different forms and should not be construed as limited to the embodiments set forth herein; rather, these embodiments are provided for thoroughness and completeness, and fully convey the scope of the present disclosure to the skilled person. Like reference characters refer to like elements throughout.

Figure 1B:
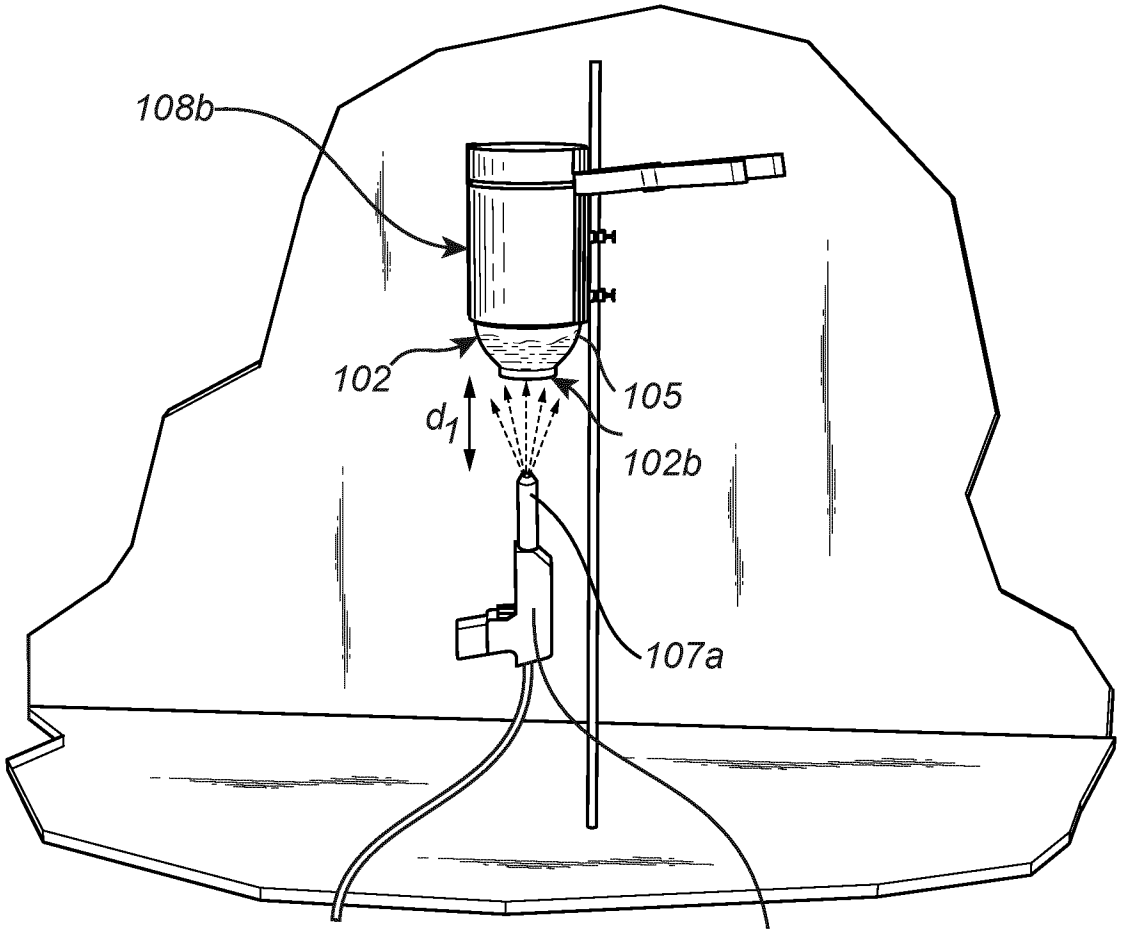
FIG. 1*b* schematically illustrates the step of providing an exterior barrier coating on the upper portion of a container according to an exemplary embodiment of the method of the present disclosure.
Figure 2:
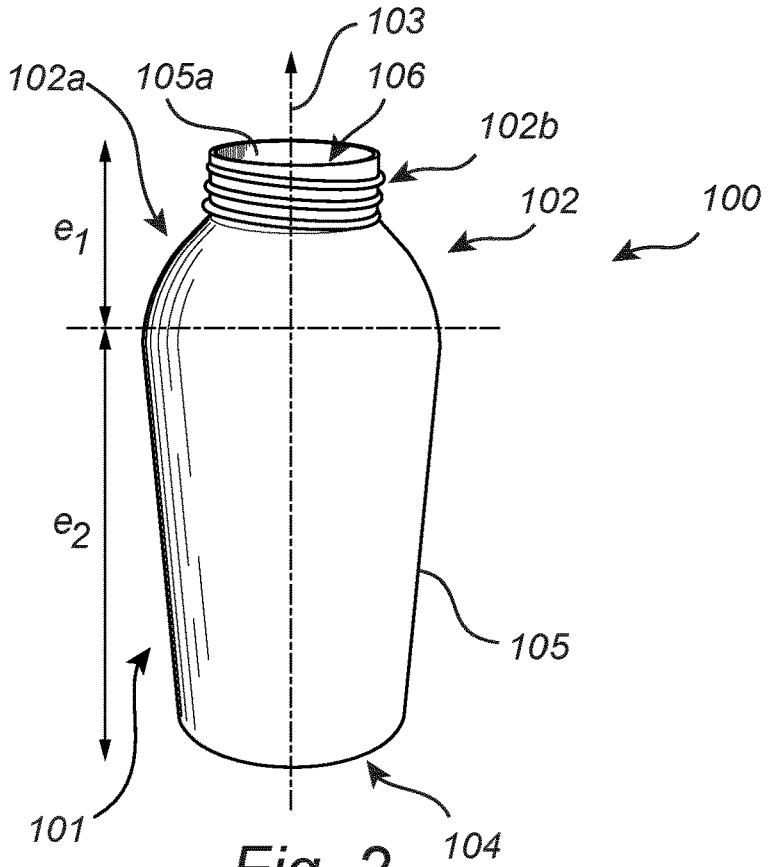
FIG. 2 schematically illustrates a bottle comprising molded pulp formed according to the method shown in FIGS. 1*a-b*.

In FIGS. 1*a-b*, a method for providing a barrier coating on a hollow container comprising molded pulp is conceptually illustrated. FIG. 2 illustrates a hollow container, i.e. a bottle, formed by the method of the present disclosure The method of the present disclosure comprises:

a) providing a hollow container 100 comprising molded pulp, wherein the hollow container comprises a main portion 101 and an upper portion 102; the hollow container extending along a longitudinal center line 103, wherein the longitudinal extension of the upper portion 102 corresponds to 5-30% of the maximum longitudinal extension of the hollow container and wherein the longitudinal extension of the main portion 101 corresponds to 70-95% of the maximum longitudinal extension of the hollow container, and wherein the hollow container comprises a bottom surface 104 and sidewalls 105 extending from the bottom surface to an opening of the hollow container; the sidewalls 105 and the bottom surface 104 defining an exterior surface and an interior surface 105*a* of the hollow container, b) depositing a polymeric powder onto the interior surface 105*a* of the hollow container 100 by means of a spraying device 107 capable of charging the polymeric powder prior to or during deposition of the polymeric powder, wherein at least the main portion 101 of the hollow container 100 is grounded during the polymeric powder deposition, c) depositing a polymeric powder onto the exterior surface of at least a portion of the upper portion 102 of the hollow container 100 by means of the spraying device 107, d) treating the hollow container with heat or irradiation under conditions that melt and/or cure the polymeric powder to form a barrier coating after steps b) and c).

As used herein, the term "hollow container" means any kind of container, such as a jar, tray, cup, bowl or a bottle. In the embodiments illustrated in the figures, the hollow container is a bottle. In embodiments, the hollow container has a rotational symmetry about the longitudinal center line. For example, the shape of the hollow container is generally cylindrical.

As used herein, the term "molded pulp" means a pulp or a pulp mixture that is shaped, pressed and dried. The molded pulp is may e.g. be made from paper or wood fibers. For example, the pulp may be a fibrous material produced by mechanically or chemically reducing woody plants to their component parts and then suspended in a fluid, e.g. water.

The "interior surface" of the hollow container is defined by the sidewalls and the bottom surface of the container. The interior surface may also be referred to as the interior walls.

The "exterior surface" is defined by the sidewalls and the bottom surface of the container. The exterior surface may also be referred to as the exterior walls.

The polymeric powder used for coating of the hollow container is not limited. For example, the powder may comprise a thermoplastic polymer selected from polyolefins, e.g. polyethylene or polypropylene and copolymers thereof, polyamides and polyesters, and copolymers thereof. The polymeric powder may also comprise water soluble synthetic polymers, such as polyvinyl alcohol or polysaccharides, such as cellulose. The powder particles typically have an average size in the range of 1 to 200 μm, e.g. from 5 to 100 μm, e.g. from 10 to 50 μm. These ranges allow for an even coating, and furthermore allow for charging of the polymeric powder particles to be accomplished by the spraying device.

The longitudinal extension of the upper portion 102 corresponds to 5-30%, preferably 10-20% of the maximum longitudinal extension of the hollow container. The longitudinal extension of the upper portion is denoted e1 in FIG. 2.

The longitudinal extension of the main portion 101 corresponds to 70-95%, preferably 80-90% of the maximum longitudinal extension of the hollow container. The longitudinal extension of the main portion 101 is denoted e2 in FIG. 2.

A hollow container comprising molded pulp may be provided by means known to the skilled person. For example, the hollow container may be provided by depositing a pulp mixture into a mold, e.g. a split-mold, activating a pressing tool, e.g. an impermeable balloon within the interior cavity of the mold such that the pulp assumes the shape of the balloon, thereby forming the interior and exterior walls of the hollow container. The molded pulp may then be drained such that excessive water is removed. A process for providing a hollow container is e.g. described in WO16055073. Other means for providing a hollow container comprising molded pulp are also conceivable.

The hollow container may then be removed from the split-mold, and may be further conditioned prior to applying a powder coating onto the interior and exterior container walls.

In alternative embodiments, the step of providing a hollow container comprising molded pulp is achieved in the same molding device used for providing the interior and exterior coatings in steps b) and c) of the method.

As illustrated in FIGS. 1*a-b*, the spraying device 107 used for polymeric powder coating is a spray gun. The method is by no means limited to the use of a spray gun, but any spraying device capable of charging the powder prior to or during deposition of the powder can be used. The powder is typically charged by corona charging; i.e. the powder particles pass through a charged corona field at the tip or nozzle of the spray gun, which applies a negative (or positive) charge to each of the polymeric powder particles. This allows for the powder particles to strongly adhere to the grounded and electrically conductive parts of the hollow container and stick thereto.

As illustrated in FIGS. 1*a-b*, the spraying device 107 comprises a nozzle 107*a* that is inserted into the hollow container; i.e. into the bottle.

The hollow container may have a moisture content in of from 3 to 15%, e.g. from 5 to 10% during the steps of polymeric powder deposition.

The "moisture content" refers to the amount of water contained in the molded pulp container expressed as the percentage of the total weight of the molded pulp container. The moisture content is typically measured at a temperature of about 20° C.

With a moisture content in the above mentioned range, the polymeric powder has an enhanced tendency to adhere to the interior and the exterior surface of the hollow container.

The polymeric powder deposition step b) may be carried out in a molding device 108 comprising an electrically conductive material; the molding device 108 being configured to enclose at least a portion of the main portion of the hollow container.

In the method illustrated in FIGS. 1*a-b*, the polymeric powder deposition step b) is carried out in a molding device 108 comprising an electrically conductive material; the molding device 108 comprising at least a first 108*a* and a second 108*b* removable portion, wherein the first removable portion 108*a* is configured to enclose the upper portion 102 of the container and wherein at least the second removable portion 108*b* is configured to enclose the main portion 101 of the container.

In the embodiment illustrated in FIGS. 1*a-b*, the molding device 108 also comprises a third removable portion 108*c*. The first removable portion 108*a* is configured to enclose the upper portion 102 of the hollow container, and the second 108*b* and the third 108*c* removable portions are configured to enclose the main portion 101 of the hollow container.

The term "enclose", in this context means that the removable mold portions surround and contact the hollow container portions such that an evenly grounded and electrically conductive surface is achieved. In embodiments, the respective removable mold portion has a shape that matches the shape of the hollow container portions.

The molding device 108 is configured to enclose the hollow container 100 to secure grounding and contact with an electrically conductive surface during polymeric powder deposition.

The molding device 108 may e.g. comprise a metal, such as aluminum.

In alternative embodiments, the molding device comprises a formable electrically conductive material.

The term "formable" means that the electrically conductive material of the molding device has the ability to conform or adapt to the shape of the hollow container when applying a moderate load. For example, the formable electrically conductive material may be an electrically conductive thermoplastic elastomeric co-polyester (TPC-ESD), an electrically conductive foam comprising e.g. polyurethane, an electrically conductive felt, such as a polyester fabric, or an electrically conductive rubber. The formable electrically conductive material may also be coated with a metal.

The inventors have found that by utilizing a formable molding device, a more even coating thickness is achieved. Furthermore, the deposition of the polymeric powder is less dependent on the moisture content of the hollow container. By utilizing a formable electrically conductive material, a moisture content in the range of from 3 to 10% may be utilized during the steps of polymeric powder deposition (steps b and c).

In embodiments where the molding device 108 comprises a metal, a moisture content in the range of from 8 to 15%, e.g. from 10 to 15% is typically utilized during the steps of polymeric powder deposition (steps b and c).

The method may further comprise the step of:

a') conditioning the hollow container at an ambient relative humidity of from 30 to 100%, preferably from 30 to 70%, after step a) of providing a hollow container comprising molded pulp.

In embodiments, where the molding device comprises metal as the electrically conductive material, the method may further comprise the step of a') conditioning the hollow container at an ambient relative humidity of from 60 to 100%, e.g. from 75 to 95%, after step a) of providing a hollow container comprising molded pulp.

The polymeric powder deposition step b) is typically performed directly after the step a') of conditioning to maintain the moisture content of the hollow container during powder coating.

The conditioning time may be at least 2 hours, e.g. at least 10 hours, preferably at least 15 hours at an ambient relative humidity of from 60 to 100%, e.g. from 75 to 95%. The conditioning is typically performed at room temperature.

As illustrated in FIG. 1*a*, the main portion 101 and the upper portion 102 of the container are enclosed by the molding device 108 during the polymeric powder deposition step b).

The interior powder coating may be provided by continuously spraying the interior of the hollow container for about 1 to 20, e.g. 2 to 10 seconds. Charged particles are blown from the nozzle 107*a* towards the interior walls 105*a* of the container. An even electrical field is achieved by means of the molding device 108 enclosing the main and upper portions of the container. Accordingly, an even and uniform barrier coating covering substantially all parts of the interior walls of the container is achieved.

FIG. 1*b* illustrates the step of providing an exterior coating on the exterior surface of the upper portion 102 of the container 100. In this step, the first removable portion 108*a* is removed from the molding device 108.

The tip of the spraying device 107 is arranged at an axial distance, d1, of from 10 mm to 250 mm, preferably of from 40 mm to 150 mm from the opening of the container. Typically, spraying is achieved by arranging the tip or the nozzle of the spraying device 107 in a vertical position with respect to the center of the opening of the container; i.e. along the longitudinal center line.

The hollow container is preferably a bottle. As illustrated in FIG. 2, the bottle comprises a bottom surface 104 and sidewalls 105 extending from the bottom surface 104 to an opening 106 of the bottle; the sidewalls 105 defining the main portion 101 and the upper portion 102 of the bottle. The bottle may have a rotational symmetry about the longitudinal center line 103. The bottle typically has a substantially cylindrical shape.

The upper portion 102 comprises a shoulder portion 102*a* and a neck portion 102*b*, wherein the neck portion 102*b* has a smaller cross-sectional area than the main portion 101 and is configured to circumferent at least the opening 106 of the bottle, and wherein the shoulder portion 102*a* is arranged to taper between the main portion and the neck portion.

The shoulder portion typically tapers at an angle of from about 5 to 75 degrees, e.g. from 20 to 60 degrees between the main portion and the neck portion.

In the embodiment illustrated in FIG. 2, the neck portion 102*b* is threaded. A threaded neck portion may be beneficial in various bottle applications, but the present disclosure is not limited to the neck portion being threaded.

The neck portion 102*b* of the bottle is the portion subject to most moist and liquid. This portion is coated in the step c) of the method. The neck portion has a smaller cross-sectional area than the remaining parts of the upper portion 102 of the bottle.

In embodiments, where the neck portion 102*b* is threaded, the threaded portion typically has a trapezoidal configuration; i.e. a "screw thread profile" which enables a cap to be screwed thereto.

The main portion 101 and the upper portion 102 (comprising the neck portion and the shoulder portion) of the hollow container are formed integrally.

In the step of providing an exterior coating (step c), at least the neck portion 102*b* of the upper portion is coated.

After, the steps of polymeric powder deposition b) and c), the hollow container is subject to treatment with heat and/or irradiation under conditions that melt and/or cure the polymeric powder.

When the polymeric powder is exposed to elevated temperatures or to irradiation, e.g. ultraviolet radiation, the deposited polymeric powder coatings soften, melt and/or cure and a continuous barrier coating is provided.

Accordingly, a uniform barrier coating, free from pinholes is achieved.

Depending on the characteristics of the polymeric particles and the desirable thickness of barrier coating, the heat treatment step may vary.

In embodiments, the hollow container is subject to heat treatment at a temperature of from 100° C. to 300° C. The heat treatment time may be between 1 and 30 minutes.

Alternatively, the powder coatings may be treated with ultraviolet (UV) light, which typically allows for a fast melting and curing of the powder coating.

In exemplary embodiments, the curing step d) is performed by heating the hollow container at a temperature of from 120° C. to 220° C. during 1 to 30 minutes.

For example, the curing step may be performed by heating the hollow container at a temperature of from 150° C. to 200° C., preferably from 170° C. to 190° C. for 5 to 20 minutes, preferably from 6 to 15 minutes.

The method of the present disclosure allows for coating of both the interior surface and the exterior surface prior to heat (or irradiation) treatment. Accordingly, only one curing or melting step is required in the method. This is beneficial since the method is considerably simplified and saves time compared to if e.g. heating would have to be performed after the respective coating steps b) and c).

The step(s) of providing the interior and the exterior coatings in the same spraying sequence(s); i.e. prior to the heating or irradiating the polymeric powder coating may be connected to the moisture content of the hollow container. If the moisture content is higher, the exterior surface of the upper portion of the hollow container may be coated without connection to a grounded electrically conductive surface during the polymeric powder deposition. Depending on the material utilized as the electrically conductive material in the molding device, the moisture content may vary.

The method of the present disclosure is not limited to a particular pulp, but any pulp may be utilized.

In exemplary embodiments, the molded pulp is formed from a mixture of a first and a second pulp, wherein

- the first pulp comprises 65-90%, such as 70-84%, by dry weight of a first pulp having a Schopper-Riegler (SR) number according to ISO 5267-1 of below 48, preferably below 40, more preferably below 30; and
- the second pulp comprises 10-35%, such as 16-30%, by dry weight of a second pulp having a Schopper-Riegler (SR) number according to ISO 5267-1 of 60-90, preferably 70-90, more preferably 77-90.

Such a pulp mixture allows for an enhanced strength of the walls of the container and also affects how quickly the pulp can be dewatered in the mold. Accordingly, the step of providing a hollow container can be achieved in a quicker and more robust manner.

The first pulp may be unrefined or only modestly refined.

The second pulp typically has a higher degree of refining than the first pulp. Accordingly, the average fiber length is greater in the first pulp than in the second pulp.

The first and/or the second pulp may comprise "market pulp"; i.e. pulp produced in one location, dried and shipped to another location for further processing.

Preferably, at least 50%, e.g. at least 75%, e.g. at least 90% by dry weight of the first and/or second pulp is softwood pulp. Such pulp mixture allows for stronger container walls to be provided.

The thickness of the barrier coating formed by the method according to the present disclosure may be in the range of from 5 to 300 μm, e.g. from 10 to 200 μm, e.g. from 20 to 100 μm.

The thickness of the barrier coating means the thickness of the cured barrier coating; i.e. the thickness of the coating after the hollow container has been treated with heat or irradiation under conditions that melt and/or cure the polymeric powder.

In another aspect, there is provided a hollow container, formed according to the method described hereinbefore.

With reference to FIG. 2, the hollow container comprises a main portion 101 and an upper portion 102; the hollow container extending along a longitudinal center line 103, wherein the longitudinal extension of the upper portion 102 corresponds to 5-30% of the maximum longitudinal extension of the hollow container 100, and wherein the longitudinal extension of the main portion 101 corresponds to 70-95% of the maximum longitudinal extension of the hollow container 100, wherein the hollow container comprises a bottom surface 104 and sidewalls 105 extending from the bottom surface 104 to an opening 106 of the hollow container; the sidewalls 105 and the bottom surface 104 defining an exterior surface and an interior surface 105*a* of the hollow container, wherein the hollow container comprises a barrier coating comprising polymeric powder on the interior surface 105*a* of the hollow container and on the exterior surface of at least a portion of the upper portion 102 of the hollow container.

Preferably, the hollow container is a bottle; the upper portion 102 comprising a shoulder portion 102*a* and a neck portion 102*b*; wherein the neck portion has a smaller cross-sectional area than the main portion and is configured to circumferent at least the opening 106 of the bottle, and wherein the shoulder portion is arranged to taper between the main portion and the neck portion; wherein the bottle comprises a barrier coating comprising polymeric powder on the interior surface 105*a* of the bottle and on at least the exterior surface of the neck portion 102*b* of the bottle.

The exterior surface of the main portion 101 of the bottle preferably does not comprise any barrier coating. In other words, the exterior surface of the main portion of the bottle is void of a barrier coating comprising polymeric powder. Accordingly, the main part of the exterior surface of the bottle will have a paper like appearance with no gloss.

Example 1: Powder Coating of the Interior and Exterior Surface of a Bottle Comprising Molded Pulp The aim of the test was to apply a polymer powder coating to the interior surfaces of the bottle and the exterior surfaces of the upper portion; i.e. the neck portion, of the bottle prior to subjecting the coatings to heat treatment.

Three paper bottles were used in the testings. Each bottle comprised a pulp formed from a mixture of chemical and mechanical pulp.

The bottles were mounted in an aluminum molding device, hung upside down as illustrated in FIGS. 1*a*-*b*. The aluminium molding device comprised three removable portions. The spray gun used to deposit the powder coatings was a Nordson Encore HD automatic powder coating gun. The polymeric powder used was a HDPE powder with a particle size distribution of 0-80 um.

The spray gun nozzle was inserted in each bottle approximately 10 mm from the bottom surface of the bottle. The spraying sequence lasted for about 5-7 seconds, and was continuous while moving the spray gun out of the bottle.

Thereafter the portion of the molding device covering the upper portion of the bottle was removed, screw holes were covered and the bottles were sprayed once more by holding the spray gun about 100 mm from the bottle opening (see FIG. 1*b*). The adherence and coverage of the powder on the outside neck and shoulder of the bottles; i.e. the upper portion of the bottles were reported.

Three different bottles were used in the testings. Two bottles were conditioned at 23° C., 90% RH (moisture content of about 14%), overnight, and one bottle was conditioned at 23° C., 50% RH (moisture content of about 7%), overnight.

Figure 3A:
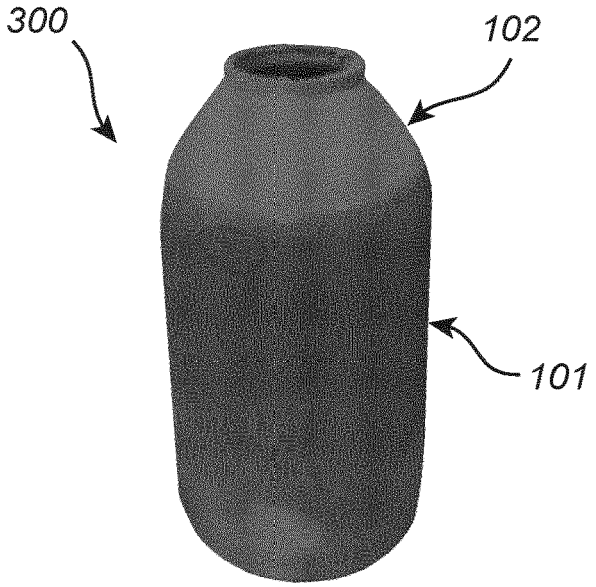
FIG. 3*a* illustrates a bottle comprising molded pulp that has been coated according to the method of the present disclosure, wherein the bottle has been conditioned at a relative humidity of 90%.
Figure 3B:
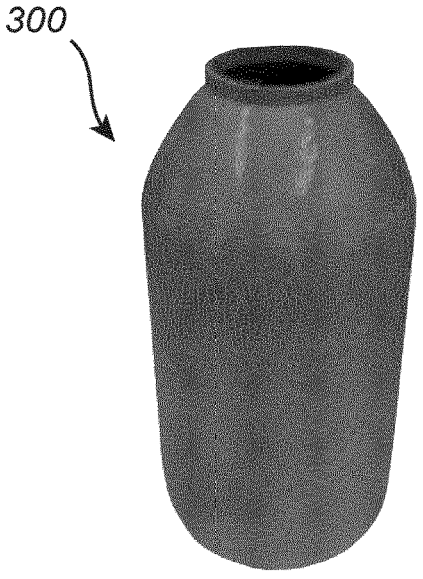
FIG. 3*b* illustrates the bottle of FIG. 3*a* after heat treatment.

Bottles conditioned at 90% relative humidity (RH) had a very good coverage and the complete upper portion; i.e. neck portion, of the bottle exhibited an even exterior coating. The results are illustrated in FIGS. 3*a* and 3*b*. FIG. 3*a* illustrates the exterior coating 103 on the upper portion of the bottle 300. The main portion 101 of the bottle 300 does not have any coating on the exterior walls. FIG. 3*a* illustrates the bottle 300 after curing.

For the bottle cured at 50% RH, a smaller powder coverage of the exterior surface of the upper portion of the bottle was achieved.

Example 2: Powder Deposition Utilizing a Molding Device Comprising a Formable Electrically Conductive Material—Coating Thickness on Sealing Area The aim of the test was to, by the use of a formable molding device, apply a polymer powder coating on both the interior and exterior surface of the bottle at a lower moisture content than in Example 1. The molding device was made from electrically conductive thermoplastic elastomeric copolyester in the shape of the bottle. When the bottle was placed in the molding device, approximately 15 mm of the neck area was uncovered, i.e. not in direct contact with the mold material making it possible to coat both the exterior and top surface of the bottle.

The spray gun used to deposit the powder coatings was a Nordson Encore HD automatic powder coating gun. The polymeric powder used was a HDPE powder with a particle size distribution of 0-100 μm.

The bottles were mounted in the grounded formable molding device, hung upside down. The spray gun nozzle was positioned about 40 mm from the bottle entrance. The powder spraying started as the nozzle moved towards the bottle neck/bottle entrance. The nozzle kept spraying while traveling to about 10 mm from the bottom inside surface of the bottle were the spraying stopped. The nozzle then returned to its start position, about 40 mm from the bottle entrance, and stationarily sprayed the uncovered neck area of the bottle. The total spray time was 4 seconds.

A total of nine paper bottles were used during the test. Five of the bottles had a moisture content of 8.5% (measured at a temperature of about 20° C.) and four of the bottles had a moisture content of 5.2% (measured at a temperature of about 20° C.).

The bottles were sprayed according to above mentioned procedure and the coating weight was measured directly after. For the bottles with 8.5% moisture content, the average coating weight was 3.06 g (standard deviation of 0.07 g). For the bottles with 5.2% moisture content, the average coating weight was 3.24 g (standard deviation of 0.16 g).

After the coating weight had been measured, the bottles were placed in an oven at 180° C. for 10 min. The thickness of the coating layer around the circumference of the sealing area was then measured using an optical microscope.

The bottles with 8.5% moisture content had an average coating layer thickness on the sealing area of 103.6 μm (standard deviation of 29.7 μm). The total number of measurements were 219 positions on the sealing area of the five bottles. The bottles with 5.2% moisture content had an average coating layer thickness on the sealing area of 95.3 μm (standard deviation of 28.5 μm). The total number of measurements were 173 positions on the sealing area of the four bottles.

Example 3: Powder Deposition Utilizing a Molding Device Comprising a Formable Electrically Conductive Material—Coating Thickness on Interior Bottle Surface The aim of the test was to, by the use of a formable molding device and an optimized spraying sequence, apply a more even polymer powder coating on the interior surface of the bottle. The molding device was, as in example 2, made from electrically conductive thermoplastic elastomeric copolyester in the shape of the bottle, with approximately 15 mm of the neck portion being uncovered.

For these trials the spray gun nozzle was initially positioned 10-15 mm from the bottom inside surface of the bottle. The powder spraying started as the nozzle started to move downwards towards the bottle neck/bottle entrance. The nozzle kept spraying while traveling to about 40 mm outside of the bottle entrance were the spraying stopped. The nozzle then remained stationary at this position and sprayed the bottle neck and threads. The total spraying time was 5 s.

A total of four bottles were used in the test, all with a moisture content of 5.2% (measured at a temperature of about 20° C.). The average coating weight was 3.48 g (standard deviation of 0.09 g).

The coating weight was measured directly after spraying, and the bottles were placed in an oven at 180° C. for 10 minutes. The thickness of the coating layer on the interior surface was then measured using an optical microscope by splitting the bottles in half and looking at the coating layer on the cut surface.

The average coating thickness in the bottles was 169.2 μm (standard deviation of 49.9 μm). The total number of measurements was 720 taken at different positions along the complete cut surface of all four bottles.

Example 4: Moisture Barrier Properties

The aim of the test was to evaluate the moisture barrier properties of bottles coated with the molding device comprising a formable electrically conductive material and spray sequences as described in Example 2.

A total of four paper bottles were used during the tests. The paper bottles were conditioned at 50% relative humidity (at 23° C.). The moisture content of the bottles (when applying the polymeric powder) was about 7% for all bottles. The average coating weight was 3.4 g (standard deviation of 0.1 g). After the coating weight had been measured, the bottles were placed in an oven at 180° C. for 6 min to melt the powder and form a continuous film. The moisture barrier properties of the bottles were then measured with Permatran. During the tests, the bottle necks were sealed onto a steel plate with epoxy resin. The average WVTR (23° C., 50% RH) was measured to 0.006 g/day and the average WVTR (38° C., 90% RH) to 0.04 g/day.

Accordingly, all four bottles displayed excellent moisture barrier properties.

Terms, definitions and embodiments of all aspects of the present disclosure apply mutatis mutandis to the other aspects of the present disclosure.

Even though the present disclosure has been described with reference to specific exemplifying embodiments thereof, many different alterations, modifications and the like will become apparent for those skilled in the art.

Variations to the disclosed embodiments can be understood and effected by the skilled addressee in practicing the present disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A method for providing a barrier coating on a hollow container (100) comprising molded pulp; said method comprising:

a) providing a hollow container (100) comprising molded pulp, wherein said hollow container (100) comprises a main portion (101) and an upper portion (102); said hollow container extending along a longitudinal center line (103), wherein the longitudinal extension of said upper portion (102) corresponds to 5-30% of the maximum longitudinal extension of said hollow container (100), and wherein the longitudinal extension of said main portion (101) corresponds to 70-95% of the maximum longitudinal extension of said hollow container (100), wherein said hollow container comprises a bottom surface (104) and sidewalls (105) extending from said bottom surface (104) to an opening (106) of said hollow container; said sidewalls (105) and said bottom surface (104) defining an exterior surface and an interior surface (105*a*) of said hollow container;

b) depositing a polymeric powder onto the interior surface (105*a*) of said hollow container (100) by means of a spraying device (107) capable of charging the polymeric powder prior to or during deposition of said polymeric powder, wherein at least said main portion (101) of said hollow container (100) is grounded during said polymeric powder deposition, wherein said polymeric powder deposition step b) is carried out in a molding device (108) comprising an electrically conductive material, and wherein said molding device (108) comprises at least a first (108*a*) and a second (108*b*) removable portion, wherein said first removable portion (108*a*) is configured to enclose said upper portion (102) of said hollow container (100) and wherein said second removable portion (108*b*) is configured to enclose said main portion (101) of said hollow container (100);

c) depositing a polymeric powder onto the exterior surface of at least a portion of said upper portion (102) of said hollow container (100) by means of said spraying device (107), wherein the exterior surface of said main portion (101) is void of a barrier coating comprising polymeric powder, wherein said polymeric powder deposition step c) is performed by arranging said spraying device (107) at a distance, d1, of from 10 mm to 250 mm from said opening (106) of said container, wherein said first removable portion (108*a*) is removed from said molding device (108) during said polymeric powder deposition step c); and d) treating said hollow container with heat or irradiation under conditions that melt and/or cure said polymeric powder after said steps b) and c).

2. The method according to claim 1, wherein said hollow container has a moisture content of from 3 to 15% during said steps of polymeric powder deposition.

3. The method according to claim 1, wherein said molding device comprises a formable electrically conductive material.

4. The method according to claim 1, further comprising the step of:

a') conditioning the hollow container at an ambient relative humidity of from 30 to 100%, after step a) of providing said hollow container comprising molded pulp.

5. The method according to claim 1, wherein said polymeric powder deposition steps b) and c) are performed simultaneously.

6. The method according to claim 1, wherein said hollow container is a bottle, wherein said upper portion (102) comprises a shoulder portion (102*a*) and a neck portion (102*b*), wherein said neck portion has a smaller cross-sectional area than said main portion and is configured to circumferent at least said opening (106) of said bottle, and wherein said shoulder portion (102*a*) is arranged to taper between said main portion (101) and said neck portion (102*b*).

7. The method according to claim 6, wherein at least said neck portion (102*b*) of said upper portion (102) is coated in said polymeric powder deposition step c).

8. The method according to claim 6, wherein the entire upper portion (102) of said hollow container (100) is coated in said polymeric powder deposition step c).

9. The method according to claim 1, wherein said step d) is performed by heating said hollow container (100) at a temperature of from 120° C. to 220° C., for 1 to 30 minutes.

10. A hollow container (100) formed by the method according to claim 1, wherein the hollow container comprises a main portion (101) and an upper portion (102); said hollow container extending along a longitudinal center line (103), wherein the longitudinal extension of said upper portion (102) corresponds to 5-30% of the maximum longitudinal extension of said hollow container (100), and wherein the longitudinal extension of said main portion (101) corresponds to 70-95% of the maximum longitudinal extension of said hollow container (100), wherein said hollow container comprises a bottom surface (104) and sidewalls (105) extending from said bottom surface (104) to an opening (106) of said hollow container; said sidewalls (105) and said bottom surface (104) defining an exterior surface and an interior surface (105*a*) of said hollow container, wherein said hollow container comprises a barrier coating comprising polymeric powder on said interior surface (105*a*) of said hollow container and on the exterior surface of at least a portion of said upper portion (102) of said hollow container, wherein the exterior surface of said main portion (101) is void of a barrier coating comprising polymeric powder.

11. A hollow container according to claim 10, wherein said hollow container is a bottle; said upper portion (102) comprising a shoulder portion (102*a*) and a neck portion (102*b*), wherein said neck portion has a smaller cross-sectional area than said main portion and is configured to circumferent at least said opening (106) of said bottle, and wherein said shoulder portion is arranged to taper between said main portion and said neck portion, wherein said bottle comprises a barrier coating comprising polymeric powder on the interior surface (105*a*) of said bottle and on at least the exterior surface of said neck portion (102*b*) of said bottle.

12. A hollow container according to claim 10, wherein the thickness of the barrier coating is in the range of from 5 to 300 μm.

13. The method according to claim 4, wherein said step a') comprises conditioning the hollow container at an ambient relative humidity of from 60 to 100% after step a) of providing said hollow container comprising molded pulp.

14. The container according to claim 12, wherein the thickness of the barrier coating is in the range of from 20 to 100 μm.

* * * * *